United States Patent [19]

Hanson

[11] Patent Number: 4,914,888

[45] Date of Patent: Apr. 10, 1990

[54] SUPPORT FRAME FOR GLASS PANEL

[75] Inventor: Laurence B. Hanson, Sandy, Utah

[73] Assignee: Capitol Glass & Aluminum Corporation, Salt Lake City, Utah

[21] Appl. No.: 237,829

[22] Filed: Aug. 29, 1988

[51] Int. Cl.[4] ..... E04B 01/60

[52] U.S. Cl. ..... 52/768; 52/767; 52/780; 52/781; 52/823

[58] Field of Search ..... 52/780, 768, 781, 823, 52/397, 767, 716; 403/305, 373, 383, 397, 396

[56] References Cited

U.S. PATENT DOCUMENTS

| | | | |
|---|---|---|---|
| 2,759,575 | 8/1956 | Marvin | 52/768 X |
| 2,808,136 | 10/1957 | Hammitt et al. | 52/770 |
| 2,957,483 | 10/1960 | Dunn | 52/781 X |
| 3,266,207 | 8/1966 | Birum, Jr. | 52/770 X |
| 4,110,942 | 9/1978 | Slocomb, Jr. | 52/397 X |
| 4,184,297 | 1/1980 | Casamayor | 52/716 X |
| 4,463,535 | 8/1984 | Wendt | 52/781 X |
| 4,762,904 | 8/1988 | Nakama | 52/823 X |
| 4,775,570 | 10/1988 | Ohlenforst et al. | 52/823 X |

*Primary Examiner*—Carl D. Friedman
*Assistant Examiner*—Lan Mai
*Attorney, Agent, or Firm*—Thorpe, North & Western

[57] ABSTRACT

A support frame for receiving and retaining a panel of glass as part of a wall or door assembly. This support frame includes an integrally, formed body of uniform cross section and unibody construction having (i) a pair of opposing side walls joined by (ii) an interconnecting support bridge which extends between opposing inner faces of the side walls and includes an upper and a lower face. The inner faces of the side walls and upper face of the support bridge define a channel configured to receive the panel of glass at one edge. The support bridge includes a recessed slot formed into one of the faces to sufficient depth to form a hinge axis operable with respect to the opposing side walls for enabling rotational displacement of the inner faces against the inserted glass panel in a gripping manner. Screws are inserted through an opening in one side wall into a threaded opening in the second side wall and operate to draw the two side walls into gripping contact at the glass panel.

18 Claims, 3 Drawing Sheets

SUPPORT FRAME FOR GLASS PANEL

BACKGROUND OF THE INVENTION

1. Field of Invention

This invention relates to a glass wall or door structure, and more specifically to a support frame for receiving and supporting a panel of glass as part of a wall system or door structure.

2. Prior Art

Glass room enclosures continue to be popular among the various construction techniques for offices, professional buildings and the like. Utilization of glass as an enclosing wall structure requires the use of a support frame which secures the glass panel to floor and ceiling in a rigid and safe manner. Because of its popularity in a wide range of architectural designs, numerous items of hardware have been developed to facilitate mounting glass structure as part of a wall or door assembly, while retaining an aesthetic property which is appealing and compatible with interior designs. Most of this hardware is component oriented, meaning that the assembled hardware structure is made up of parts which are screwed or joined together to enclose the edge of the glass panel and provide secure mounting at floor and ceiling.

Various systems of components which have or may be adapted as support structure for glass panels are represented in the following U.S. Pat. Nos.:

U.S. Pat. No. 4,680,903
U.S. Pat. No. 3,363,390
U.S. Pat. No. 2,808,136
U.S. Pat. No. 1,985,174
U.S. Pat. No. 1,430,757
U.S. Pat. No. 2,299,508

Each of these patents except for U.S. Pat. No. 3,363,390 demonstrates the standard practice of component assembly. This basic design approach involves the interattachment of a front and back panel as separate components with a mounting base adapting the structure for positioning and securing to the floor or ceiling. In contrast, U.S. Pat. No. 3,363,390 shows an integral structure formed of plastic which utilizes angled phlanges in a receiving channel to grasp and retain the glass panel once inserted. A major problem with this structure is its inability to handle heavier weight glasses which are typically used for wall construction. Indeed, the patent focuses on lighter weight glass panels used as part of a window assembly, therefore the problems of extreme weight and proper horizontal/vertical orientation with respect to the floor and ceiling levels do not apply.

In contrast with the window applications of glass frames, door and wall construction often require an adjustment to improve the squareness of the door and wall unit to conform to the relative out-of-squareness in variations in the height of the building opening. Obviously, doors and walls must appear parallel and square in glass or rigid material systems, as well as meeting the constructural requirements of squareness in an absolute sense.

Other problems which arise with glass wall panels include concealment of conduits such as electrical, telephone and computer cable. Not only should such cable be hidden from normal view, but it must also be accessible for repair and maintenance. Because of this limitation, as well as the need to have glass panel structure of modular design so that walls can be assembled or disassembled, component construction has been the dominant method for glass panel enclosures. To attempt to apply the integral construction represented in the window frame of U.S. Pat. No. 3,363,390 poses numerous obstacles, including the ability to make adjustments for squareness, enclosures for conduit and modular design to permit installation as well as disassembly.

In contrast to modular constructions, prior art glass door and wall panels have been produced in factories to exact dimensions supplied by the contractor. Such preformed panels are rigidly attached by a cementing glue and lack adjustability which is sometimes necessary in view of unexpected changes in construction sizes. Accordingly, preformed wall panel structures have not been widely accepted. The dominant practice of utilizing component elements to assemble a wall structure remains the most common approach to the problem of glass panel construction. Such multiple component support frames continue to be used, despite the fact that they are cumbersome to assemble and adjust and generally expensive to purchase and install. Both the preformed wall constructions fabricated to contractor specification and the multi-conponent systems may be subject to damage during construction and/or adjustment. Such systems lack the flexibility to be applied in a variety of structural applications in view of the foregoing deficiencies.

OBJECTS AND SUMMARY OF THE INVENTION

It is an object of the present invention to provide a one-piece rail or support frame which can be easily installed on glass or other rigid material and readily adjusted in squareness and alignment with floor and ceiling.

It is a further object of this invention to provide such a support frame which can be quickly attached at upper and lower edges of a glass panel and readily adjusted in height to be rigidly attached at ceiling and floor surfaces, with the glass panel being captured within the support frame.

A still further object of this invention is to provide a support frame for a glass panel which includes a channel for carrying utility conduit in a concealed manner.

Yet another object of this invention is to provide a support frame for a glass panel which includes separate cladding of decorative cover material which can be applied after the construction phase is completed, thereby avoiding possible damage.

A further object of this invention is to provide a method of installation for a door or glass panel which greatly simplifies secure positioning of the panel in a proper orientaton in vertical alignment, with the upper and lower edges of the glass panel properly concealed to give an impression of squareness at the support frame.

These and other objects are realized in a support frame which is integrally formed as a unibody support member with a substantially straight body of uniform cross section having (i) a pair of opposing side walls joined by (ii) an interconnecting support bridge which extends between opposing inner faces of the side walls and includes an upper and lower face. The opposing inner faces of the side walls and upper face of the support bridge define a channel configured in size to receive an edge of the glass panel. This support bridge includes a recessed slot formed into one of its faces to a sufficient depth to form a hinge axis operable with respect to the opposing side walls and enabling rotational displacement of the inner faces of the side walls against the inserted glass panel in gripping manner. The support frame includes means for causing the rotational displacement of the side walls to grip the glass panel in a firm manner. The integrally formed support member of the support frame is fabricated of a material which has sufficient rigidity to cause at least a portion of the side walls to form a clamp against and retain the inserted glass upon frictional contact therebetween. A clad or decorative covering may be attached at the support frame to give the desired aesthetic appearance compatible with the interior design of the enclosed area.

The structure is also defined as a modular panel of glass which includes a first rail comprising an integrally formed, substantially straight body of uniform cross section as identified in the previous paragraph and being mounted as a base edge of the panel of glass and a second rail constructed in the same manner and being attached at a top edge of the panel of glass to form a single panel capable of repeated assembly and disassembly as part of a modular construction. Specific procedural steps for attaching the support frame at the base edge of the panel, securing the first rail to a floor track member, attaching a second support frame or rail at the top edge of the glass panel in a freely movable condition with respect thereto, inserting the first rail or bottom support frame into the mounting track and slidably engaging and adjusting the second rail into a position at the ceiling is also disclosed.

Other objects and features of the present invention will be apparent to those skilled in the art in view of the following detailed description, taken in combination with the accompanying drawings.

DETAILED DESCRIPTION OF THE INVENTION

Figure 1:
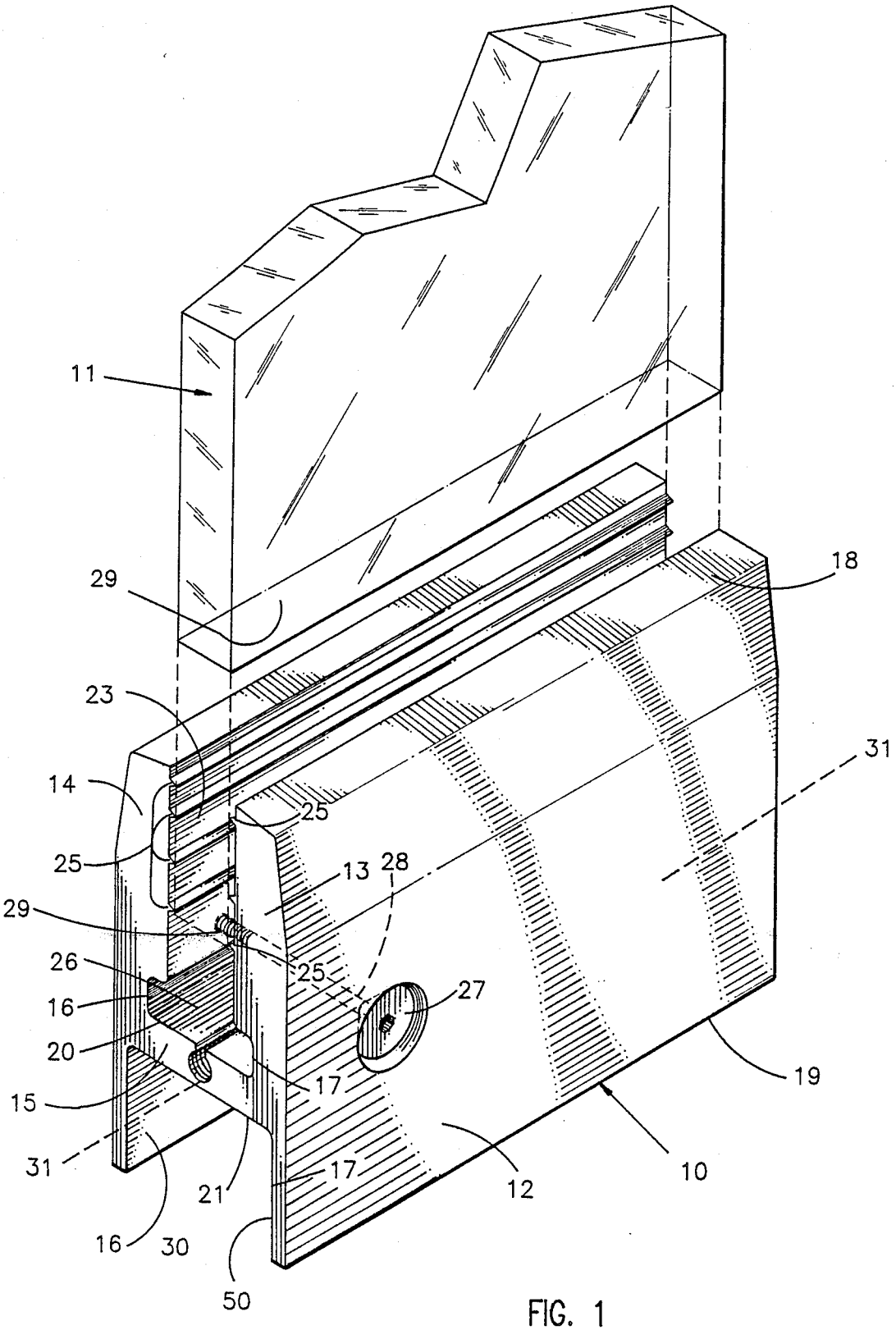
FIG. 1: shows a perspective view of a preferred embodiment of the present invention.

FIG. 1 shows a segment of a support frame 10 with a portion of a glass panel 11 ready for insertion into the frame. The illustrated glass 11 is a half-inch thick panel of safety glass typically utilized for door or wall components of a room enclosure. An advantage of the present invention is its adapatability for use with virtually any plate of wall structure, whether it be glass, plastic or other composition.

The support frame 10 includes an integrally formed body of uniform cross section 12 of unibody construction as is typically formed by an extrusion process utilizing aluminum material. As a frame member, this structure 12 is substantially straight and includes a pair of opposing side walls 13 and 14 joined by an interconnecting support bridge 15 which extends between opposing inner faces 16 and 17 of the side walls.

These respective side walls 13 and 14 may be formed in many configurations. The side wall extends from the top edge 18 of the frame to the base edge 19. The inner faces 16 and 17 likewise extend from the top edge 18 to the frame base 19 and are medially interrupted by the support bridge 15. This integral support bridge 15 ties the two side walls together in a unibody construction, it includes an upper face 20 and lower face 21. Here again, these faces may be of many geometric configurations. For example, in contrast to the flat faces 20 and 21 illustrated in FIG. 1, the geometries may be non-planar, arcuate or polyhedral faces.

The opposing inner faces 16 and 17 of the frame above the support bridge 15 and the upper face 20 of the support bridge define a channel 23 which is configured in size and shape to receive an edge 24 of the panel of glass 11. In the illustrated embodiment of FIG. 1, for example, the narrower, upper section of the channel has a width of 0.565 inches and includes a set of four projecting ribs 25 on each side of the channel. The separation distance between edges of these ribs is approximately one-half inch, corresponding to the thickness of the glass panel to be inserted therein. The depth of this upper channel section is approximately 1.5 inches. The wider section of the channel 26 has a vertical depth of approximately 0.33 inches and includes a wider span to facilitate rotational movement of the side wall members 13 and 14 as will be discussed hereafter. It will be apparent to those skilled in the art that the dimensions of this channel are merely illustrative and are specifically suited for a particular thickness of plate glass. A variety of dimensional and configuration changes may be applied without departing from the scope of the intended invention.

The invention functions to lock the plate of glass 11 within channel 23 by inward displacement of the side walls 13 and 14 against opposing faces of the glass panel. Means for causing the rotational displacement of these side walls comprises a screw 27 which passes through an enlarged opening 28 within side wall member 13, and being engaged in a threaded opening 29 in side wall member 14. Accordingly, continued rotational advancement of the screw 27 into the threaded opening 29 draws the opposing side walls 13 and 14 into closer configuration. This effectively locks the plate of glass within the upper channel 23.

To facilitate the rotational movement of these side walls 13 and 14, the support bridge includes a recessed slot 30 which is formed in one cf the faces 20 to a sufficient depth to form a hinge axis 31 operable with respect to the opposing side walls. In the FIG. 1 embodiment, the support bridge has an approximate thickness of 0.3 inches. The recessed slot extends through this thickness for a distance of approximately 0.22 inches, leaving 0.08 inch of material as connecting bridge between the opposing side wall and support bridge structures. This small mass and corresponding small moment of inertia permits rotational displacement of the side walls to grip the glass panel in response to the screw element 27.

This rotation displacement and corresponding gripping action at the glass panel is accomplished also by proper selection of materials for the unibody structure. It has been found, for example, that aluminum has sufficient rigidity to cause at least a portion of the side walls to form a clamp against and retain the inserted glass upon frictional contact therebetween. In fact, initial contact at the bottom ribs 25 nearest the rotational axis 31 are partially deformed against the glass face and operate to increase frictional contact and grip. Other materials may be suitable, provided they provide the proper balance between rigidity to enable firm grip of the glass and rotational properties as previously discussed, based upon use of the broadened channel 26 and/or recessed slot 30.

Figure 2:
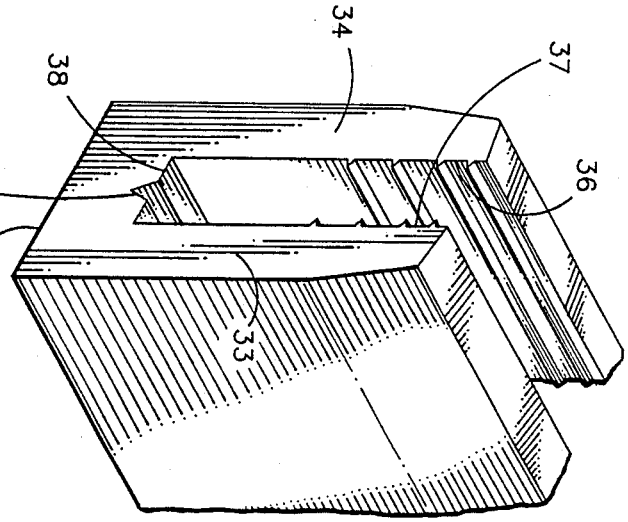
FIG. 2: illustrates a second embodiment shown in perspective.

As with the side walls, the recessed slot may also assume various configurations. FIG. 2 illustrates a support frame which includes side walls 33 and 34 and having a flat base 35. The channel is defined by inner faces 36, 37 and 38. A triangular notched slot 39 is formed in face 38 to provide the reduced material to facilitate the rotational displacement of side walls 33 and 34 inward.

Figure 3:
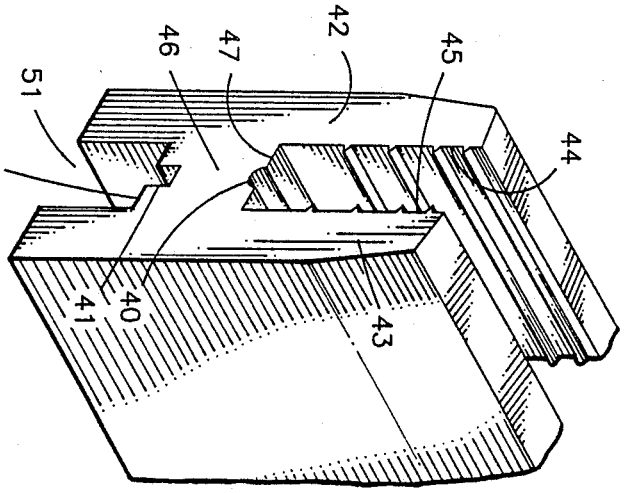
FIG. 3: shows a third embodiment, also in perspective view.

FIG. 3 illustrates another embodiment illustrating the use of two recessed slot structures 40 and 41. Side walls 42 and 43 and their interior upper faces 44 and 45 define vertical walls of the channel down to the intermediate support bridge 46. Recessed slot 40 illustrates an arcuate cut into the upper face 47 of the support bridge, while slot 41 depicts a squared groove which extends into the lower face 48 of the support bridge. These various configurations all perform the common function of reducing the resistance of the support bridge and attached side walls against rotational displacement.

In FIG. 1, this is accomplished by use of a recessed slot which is configured with a circular cross section 30 wherein a segment of the circular cross section forms an opening to the slot which projects upward toward the channel and inserted glass panel. In FIG. 2, the recessed slot is configured as a triangular cross section 39 wherein one side of the triangular cross section forms an opening projecting toward the upper channel. The recessed slots of FIG. 3 are configured with a rectangular cross section 41 having one side of the rectangular cross section form the slotted opening, and an arcuate slot similar to that shown in FIG. 1 but with less depth. As illustrated in FIG. 3, the recessed slot may be formed in either the upper face 47, lower face 48 or both.

The embodiments illustrated in FIGS. 1 and 3 show the preferred structure of the support frame wherein the support bridge interconnects the opposing side walls at an approximate medial position to form a cross section representing an "H". In these embodiments, the upper, open channel of the "H" corresponds to the channel for receiving the glass panel. The lower open channel is formed by extension of the side walls below the support bridge to form a recess 50 and 51 adapted for receiving wiring, conduit, computer cable or other concealed construction and/or utility materials.

Figure 4:
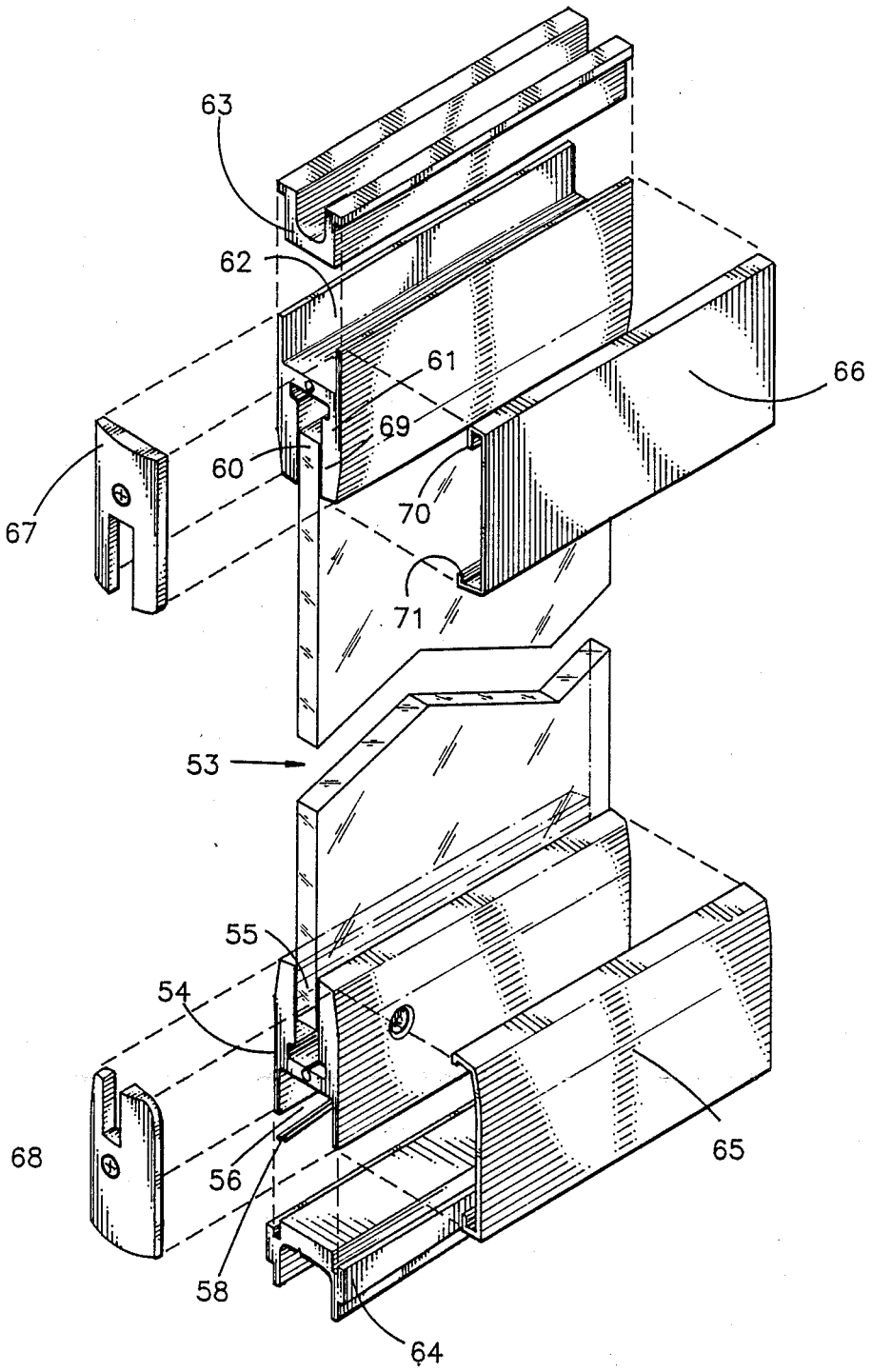
FIG. 4: shows an exploded, perpective view illustrating top and bottom sections of a glass door with framed member in accord with the present invention.

The advantage of this concealed recess or channel is evident in FIG. 4, which shows a modular panel of glass 53 which is adapted for use as part of a wall assembly. This structure includes a first rail 54 comprising an integrally formed, substantially straight body of uniform cross section with side wall and support bridge construction substantially as previously disclosed. This first rail is mounted at a base edge 55 of the panel of glass and is locked in place by the rotational displacement of the side walls as previously described. The lower channel 56 below the support bridge 57 provides a concealed space for running conduit, computer cable and other utility lines 58.

Figure 5:
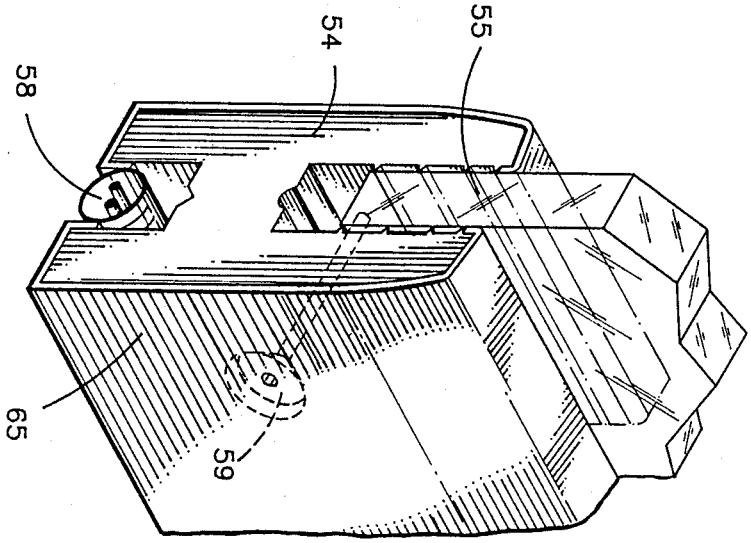
FIG. 5: depicts a further embodiment including a channel for electrical conduit.

The upper edge 60 of the glass panel is secured in a second rail 61 which is constructed in the same manner as the first rail. This rail is adapted at its upper face 62 for engagement with a ceiling track 63 which is fixed to the ceiling. The first rail 54 is adapted at its lower face for attachment to a floor track 64. As will be explained hereafter, the procedure of installation is simple and reversible and greatly facilitates the use of this panel structure as part of a modular construction. Decorative cladding 65 and 66 can be coupled to the exterior of the support frame to add aesthetic appearance including a wood grain, metallic finish or other decorative surface compatible with the interior design. End caps 67 and 68 likewise may be attached to conceal the support frame and provide decorative finish. The enlarged view of FIG. 5 illustrates the effective manner in which conduit and other construction wiring may be concealed within the support frame, while providing a decorative exterior and rigid construction to the wall panel.

The method of installation of the subject invention is represented by the following example. It includes the steps of first, attaching a support frame 54 as previously described to a base edge 55 of a panel of glass. This support frame is then locked in place by displacing the rotational displacement means 59 to grip the panel as previously recited. A base mounting track 64 is secured to a desired location at a floor surface and a vertically aligned ceiling track 63 is likewise secured in plumb orientation. A second support frame is then loosely attached at the top edge 60 of the glass panel, thereby being freely movable with respect to the top edge such that the panel slides into the channel 69. The bottom support frame 54 is then engaged with the floor track 64 and the panel is aligned for insertion into the top mounting track 63. With the bottom support frame properly positioned, the upper support frame 61 is adjusted to engage the upper track 63 and still retain the upper edge 60 of the glass panel within the channel 69. Once the alignment is properly set, the upper frame is locked in position at the glass panel by rotating the engagement screws which pull the side walls into gripping contact as previously described. When the construction and assembly are complete, decorative cladding 65 and 66 are clipped in place by attaching the cladding edges 70 and 71 around the side wall structure of the support frame.

The material selected for construction of the support frame may be aluminum, rigid plastic or fiber-reinforced composite. The unibody construction and uniform cross section make the subject invention ideal for fabrication by extrusion or pultrusion. Typically, the aluminum and rigid plastic will be extruded to the desired cross section. The fiber-reinforced composite structure is typically formed by pultrusion of the respective fiber, resin and filler components through a die or appropriate cross section.

A major advantage of the present invention is the ability to mount a glass panel or other rigid material within a support rail without the use of gaskets or complicated structure necessary to provide the necessary field adjustability for alignment. All squareness and parallelism adjustments can be made on an as needed basis with minimal difficulty and by a single individual. All construction is modular and can be assembled or disassembled with ease. After installation is complete and all risk of danger is past, decorative cladding can be added without fear of scratch or damage. Likewise, utility lines can all be run within the support structure for proper concealment. The unibody construction and simplicity of installation provide substantial reduction in cost as well as installation time. The enhanced flexibility of this construction allows its application in many situations and thereby provides further cost savings by avoiding the need to conform to special or unique specifications for a particular construction site.

It will be apparent to those skilled in the art that the foregoing description and embodiments are for illustration purposes, and are not to be construed as limiting, except as provided by the following claims.

I claim:

1. A support frame for receiving and retaining a panel of glass as part of a wall or door assembly, said frame comprising:

an integrally formed substantially straight unibody support member of uniform cross section having (i) a pair of opposing side walls joined by (ii) an interconnecting support bridge which extends between opposing inner faces of the side walls and includes an upper and a lower face;

said opposing inner faces of the side walls and upper face of the support bridge defining a channel configured in size to receive an edge of the panel of glass;

said support bridge including a recessed slot cut into one of the faces of the support bridge to a sufficient depth to form a hinge axis operable with respect to the opposing side walls and enabling rotational displacement of the inner faces of the side walls against the inserted glass in gripping manner;

means for causing the rotational displacement of the side walls to grip the inserted glass;

said unibody member being fabricated of a material having sufficient rigidity to cause the side walls to form a substantially continuous clamp against and retain the inserted glass upon frictional contact therebetween; and said sidewall displacing means including means for adjusting the amount of gripping pressure applied to the inserted glass by said side walls.

2. A support frame as defined in claim 1, wherein the recessed slot is configured with a circular cross section wherein a segment of the circular cross section forms an opening to the slot.

3. A support frame as defined in claim 1, wherein the recessed slot is configured with a triangular cross section wherein one side of the triangular cross section forms an opening to the slot.

4. A support frame as defined in claim 1, wherein the recessed slot is configured with a rectangular cross section wherein one side of the rectangular cross section forms an opening to the slot.

5. A support frame as defined in claim 1, wherein the slot is formed in the upper face of the support bridge and further forms part of the channel.

6. A support frame as defined in claim 1, wherein the slot is formed in the lower face of the support bridge.

7. A support frame as defined in claim 1, wherein the opposing inner faces of the side walls include gripping means for enhancing frictional contact of the glass panel.

8. A support frame as defined in claim 7, wherein the gripping means comprises a plurality of projecting ribs formed at the inner faces of the side walls and extending parallel with the hinge axis and configured in size, shape and composition to slightly deform upon compression against the glass to provide a tight grip on the inserted glass.

9. A support frame as defined in claim 1, wherein the material comprising the uniform body is selected from the group consisting of aluminum, rigid plastic and fiber reinforced composites.

10. A support frame as defined in claim 9, wherein the uniform cross section is formed by extrusion of the aluminum or plastic into a desired cross section.

11. A support frame as defined in claim 9, wherein the uniform cross section is formed by pultrusion of components of the fiber reinforced composite into a desired cross section.

12. A support frame as defined in claim 1, wherein the means for rotationally displacing the side walls comprises a screw inserted through aligned openings in the side walls and below the inserted glass panel, one of the openings being threaded and sized to engage threads of the screw, the other opening being sufficiently large to allow the screw to freely rotate without engaging the threads, the side walls being tightened against the glass panel by rotation of the screw to pull the two side walls together.

13. A support frame as defined in claim 1, wherein the support bridge interconnects the opposing side walls at an approximate medial position to form a cross section representing an "H", the upper open channel of the "H" corresponding to the channel for receiving the glass panel, the lower open channel of the "H" being formed by extension of the side walls below the support bridge to form a recess adapted for receiving wiring, conduit and other concealed construction and utility materials.

14. A support frame as defined in claim 1, further comprising means for attachment of decorative cladding over an outer, exposed face of the side walls.

15. A modular panel of glass adapted for use as part of a wall or door assembly, said panel comprising:

a first rail comprising an integrally formed, substantially straight unibody support member of uniform cross section having (i) a pair of opposing side walls joined by (ii) an interconnecting support bridge which extends between opposing inner faces of the side walls and includes an upper and a lower face;

said opposing inner faces of the side walls and upper face of the support bridge defining a channel configured just large enough in size to receive an edge of the panel of glass;

said support bridge including a recessed slot cut into one of the faces of the support bridge to a sufficient depth to form a hinge axis operable with respect to the opposing side walls and enabling rotational displacement of the inner faces of the side walls into closer spacial relationship;

means for rotationally displacing the side walls into gripping contact with the inserted glass;

said unibody support member being fabricated of a material having sufficient rigidity to cause the side walls to clamp against and retain the inserted glass panel upon contact therebetween;

said side wall displacing means including means for adjusting the amount of gripping pressure applied to the inserted glass by said side walls;

said first rail being mounted at a base edge of a panel of glass; and a second rail constructed in the same structure as the first rail but being attached at a top edge of the panel of glass to form a single panel capable of repeated assembly and disassembly as part of a modular construction.

16. A modular panel as defined in claim 15, wherein the means for rotationally displacing the side walls comprises a screw mounted through one side wall and journalled in a threaded opening in an opposing side wall such that rotation of the screw pulls the side walls into closer spacial relationship.

17. A modular panel as defined in claim 15, wherein the support bridge interconnects the opposing side walls of the first rail at an approximate medial position to form a cross section representing a "H", the upper open channel of the "H" corresponding to the channel for receiving the glass panel, the lower open channel of the "H" being formed by extension of the side walls below the support bridge to form a recess adapted for receiving wiring, conduit and other concealed construction and utility materials.

18. A modular panel as defined in claim 15, further comprising a mounting track including means for rigid attachment of the support frame to a floor or ceiling surface.

* * * * *